United States Patent [19]

Taylor

[11] 4,193,792

[45] Mar. 18, 1980

[54] PROCESS FOR CLASS IIIB METALS ORE REDUCTION

[76] Inventor: Paul F. Taylor, P.O. Box 468, Crossville, Tenn. 38555

[21] Appl. No.: 902,379

[22] Filed: May 3, 1978

[51] Int. Cl.[2] ..... C22B 60/00; C22B 60/02

[52] U.S. Cl. ..... 75/84; 75/84.1 R; 75/101 R; 75/108; 252/301.1 R

[58] Field of Search ..... 75/84.1 R, 84, 101 R, 75/108; 252/301.1

[56] References Cited

U.S. PATENT DOCUMENTS 3,791,815 2/1974 Taylor ..... 75/84.1 R 3,980,471 9/1976 Taylor ..... 75/84.1 R

*Primary Examiner*—Brooks H. Hunt

[57] ABSTRACT

By combining the two processes for Class IIIB metal ore reduction, namely U.S. Pat. Nos. 3,980,471 and 3,791,815, so the same reduction ingredients incorporated within both patents are mixed together with the ore to be reduced, heated until mixture is a dry and solid mass, then placed within the proper smelting medium and heated until metals are smelted out, the metals will not be brought to an intermediary powder stage as provided for in the two referenced patents but will smelt directly to the included metals.

10 Claims, No Drawings

PROCESS FOR CLASS IIIB METALS ORE REDUCTION

This application is related to U.S. Pat. Nos. 3,980,471 and 3,791,815, both owned by Paul F. Taylor as inventor, having respective applications filed June 17, 1974, Ser. No. 479,882, and Dec. 13, 1972, Ser. No. 314,809.

The present invention relates to an improved method for separating the Class IIIB metals from oxygen as chemically combined as well as from other impurities and contaminants found within the ores; such separating herein known as CLASS IIIB METALS ORE REDUCTION.

As starting materials for this process finely pulverized Class IIIB metal oxides are provided from the parent and native ores such as Monazite, Carnotite, and Uranite or Pitchblende. They are then mixed with the reduction ingredients in total as outlined in the two patents as above defined and with the mixing in any order desired. The reduction ingredients are: Sulfated surfactant type wetting agents of composition alkylphenol polyglycol ether homogenously combined into the following formulation (by weight ratio);

| | |
|---|---|
| Phosphoric acid | 24.20 No. more or less |
| Zinc Oxide | 0.50 No. more or less |
| Sulfated Surfactant | 1.00 No. more or less |

Sodium hydroxide or others of the Classes I-A and II-A series of element metals; sugars and starches of the chemical varieties known as Sucrose ($C_{12}H_{22}O_{11}$), Glucose ($C_6H_{12}O_6$), Fructose ($C_6H_{12}O_6$), animal sugar having the empirical formula as Sucrose, all of both the two general groups Disaccharides and Monosaccharides; and Starch ($C_6H_{10}O_5$). The powdered Calcium Carbonate should be at least 99% pure and is usually added last to the mixture as the mixture will begin to rise with the addition of this ingredient.

When the selected ore material and other starting materials are mixed together within a common container and heated with endothermic heat some oxygen and other impurities separate from the metals forming into chemical union with the liquid chemical solution formula and limestone, part of which is expelled in the form of gases. Also the materials interact so as to form hydrocarbon fuel which then burns and aids in removing the chemically combined oxygen from the ores and other reduction materials, and by such combined reactions the consequent reduction of the ores. The heated, boiled and burned residue is then further heated in both atmospheric as well as vacuum-inert outgassing furnaces to sufficient elevated temperatures so as to smelt out of the matrix material Class IIIB metal(s), thereby with the reductions complete.

It is, therefore, an object of the present invention process to provide an improved method for the reduction of Class IIIB (Lanthanide and Actinide) metal ores with usage of the ingredients of both patent processes U.S. Pat. Nos. 3,980,471 and 3,791,815 in combination resulting in greater reduction process strength and viability.

It is another object to provide either single metal or combined matte metal by introducing respectively single metal oxides as derived previously from the ores, or introducing the combined metal oxides of the ores, and continuing through the smelting stage, thereby eliminating the metal powder stage as inherent in the two referenced patents.

Other objects and advantages of the instant invention improvements will become apparent from a further reading of the description and the appended claims.

With the above and other objects in view, the present invention process mainly comprises a process for separating the Class IIIB metals from chemically combined oxygen and other impurities, featuring the advantage of greater process strength by combining two other ore reduction processes, continuing through the smelting stage without concern of the powdered metal stage inherent in the two individual processes, and the production of either single metal ingot or combined (matte) metal ingot according to the ore oxides thus entered into the process operation and atmospheric or vacuum-inert smelt. Further, it provides for ease of reduction operations, and economically cheaper over other known Class IIIB metal ore reduction processes aside from the two referenced and utilized (combined) patented processes.

The process begins with the stated mixing together of the starting materials within a suitable container (or alternate containers) in which the mixture may be heated and boiled, burned, then elevated to sufficient temperatures to provide smelting out of the metal(s) and in atmospheric as well as vacuum-inert outgassing furnaces; heating the mixture within effective proximity of a suitable furnace arrangement to which sufficient heat may be applied.

The mixture is first boiled with heat with stirring as necessary until mixture ignites and burns. It continues to burn as long as heat is applied (endothermic) and until ingredient reactions terminates. The residue is then heated within the stated atmospheric or vacuum-inert outgassing furnace to a higher temperature sufficient for smelting out of the metal(s), and the entire operation is attended by such mechanical arrangements as necessary for collecting and venting of the combustion flue gases, then properly disposing of the gases as they are from mildly toxic to extremely toxic according to the particular metal(s) being reduced and smelted, the ones with higher atomic weight being more toxic gas catalyzers generally.

The temperature operational range throughout the boiling period is that which is necessary for maintaining a gentle rolling boil, then increased throughout the burning (ignition) period so as to maintain ignition of the manufactured hydrocarbon gas with the ores being properly reduced, approximately in the range from 650° F. through 1600° F. The residue material is then smelted in either an atmospheric type furnace or outgassing vacuum-inert type furnace at temperatures ranging respectively from about 2700° F. for the atmospheric type to about 4000° F. for the outgassing vacuum-inert type. The temperature dividing line between the atmospheric type furnace and the outgassing vacuum-inert type furnace is approximately three thousand degrees F.; i.e. no atmospheric type furnace should be operated above 3000° F. Also, the Class IIIB metals being smelted out of the matrix material may be accomplished with the required technology being to collect the smelted metal from the bottom of the smelting crucible, or, in the case of elevated temperatures, allowed to boil (vaporize) off (the metal) and to collect the metal in proper condenser installations. In the case of more than one metal oxide being reduced and smelted at one time the latter may be more easily conducted for selective metal vaporizing and higher purity collected metal. This is at the option of the operator and after the metal ores are reduced by the instant process, the reduction being considered complete prior to the smelting operation.

OPERATIONAL EXAMPLE 1—FOR THORIUM METAL ORE REDUCTION

The operation for Thorium metal ore reduction as derived from the foregoing specification may be exemplified more particularly by an explanation for the reduction of a 16 ounce batch of Thorium ore ($ThO_2$), which the inventor has operated successfully. Example batch sizes for other amounts of Thorium ore will not be herein given as ingredient ratios for all such batches remain in the approximate same proportion as the given example. However, in lighter Class IIIB metal oxides more reduction ingredients may be required than with the heavier ones like Thorium because the volume is greater. Usually a good rule to follow for selections of reduction ingredient ratios is to use just enough of the liquid formula mixed with the ore in question FIRST so the mixture will take on the appearance of a slurry when well mixed, then add the other ingredients in proportion to the formula weight with respect to this instant Example 1. The reasoning here is to provide a mixture which may be stirred to insure homogeneity both before and during the first part of the reduction operation so as to insure proper reductions of any Class IIIB ore by the instant process, also because lighter members of the group contain more metal atoms per 16 ounces than Thorium. The ore must, therefore, always be commercially concentrated oxide so that reduction ingredients will not be consumed away by worthless gangue material, however, this is not meant to say that the process operated with excessive overburden is not effective for the reductions of the Class IIIB metal for, indeed, it is, but in the interest of economy and technologically sound operations the ore should always be as stated. The instant example Thorium oxide is commercially pure $ThO_2$ of at least 95% or better.

The reduction equipment consists of a vertical type gas-fired furnace, being circular in shape and opening from the top with a removable cover, and with a motor-powered blower, the furnace being of proper size internally to accept a silicon-carbide crucible also circular in shape so as to fit within the furnace, being approximately 12 inches tall and 6 inches wide. A proper hood cover for venting and collecting the emitted fumes for proper disposal is also provided over the furnace, and which may be raised or lowered to suit operations.

Introduced within the crucible are the mixed ingredients consisting of sixteen ounces of Thorium dioxide ($ThO_2$) of −400 or higher mesh grade, sixteen ounces of sulfated surfactant formula, about six ounces of sodium hydroxide, about twelve ounces of sugar or starch, and about two ounces of calcium carbonate, limestone ($CaCO_3$), pulverized to about −100 mesh grade. The ingredients are stirred together as long as gas issues from the mixture and prior to heating.

With the crucible resting within the furnace heat is applied until boiling commences. The heat is then regulated until a gentle rolling boil is achieved and precaution is taken that fumes are properly controlled so as not to be breathed by the operator. As the mixture becomes drier the fumes become more toxic per constant volume. When the mixture ceases to be pliable the heat is then raised to about 650° F. until mixture ignites and burns. This temperature range should be maintained until burning ceases. The temperature should be then raised to about 2800° F. and the matrix material smelted for approximately four hours. The furnace should then be shut off and allowed to cool sufficiently so the crucible may be removed and the Thorium metal ingot recovered from the bottom. At the smelting temperature the metal is in the non-fuzed state but is in ingot form. This is because Thorium metal melts at a higher temperature than 2800° F. but will smelt out of the matrix material at that temperature and collect at the crucible bottom. In the same manner metals having a much higher melting temperature than Thorium may be smelted within an atmospheric furnace but will be unfuzed as is Thorium in this instant example. Conversely metals having lower melting temperatures than the furnace temperature required for smelting will become fuzed at the crucible bottom. Thus with usage of higher furnace temperatures (above 2800° F.) as with vacuum-inert outgassing types the recovered metal in any case for the Class IIIB metals may be fuzed if desired. Also, the recovery of metal per unit ore weight is greater with usage of vacuum-inert outgassing furnaces. This is because when an atmospheric furnace is utilized some of the reduced metal is re-oxidized within the crucible and therefore is lost, but is not so lost within the vacuum-inert outgassing furnace. Furthermore, should high purity metal be required a vacuum-inert outgassing furnace may be utilized at sufficiently high temperatures so that the smelted metal is vaporized, driven into a condenser and converted to solid metal. In such an instance the furnace outgassing port would suffice for both fumes as well as vaporized metal, the fumes passing on and out and the vaporized metal collected, such existing and standard gear already in usage for other operations.

The ingredient ratios for instant example for Thorium metal are not necessarily confined to those as given (and all possible batch sizes). Example ratios present a norm and the ingredients may vary lower or higher with respect to any other of the ingredients, as reduction effectiveness and requirements dictate (for economy, efficiency, purity, ease of operations, etc.). This is also true and applies to all the Class IIIB metal ores as so reduced by instant process.

What is claimed as new and desired to be secured by Letters Patent is:

1. A method of reducing Class IIIB metal series ore oxides individually and in metal matte combinations to ingot and alloy, fuzed and nonfuzed forms, comprising the steps of:

A. Adding powdered oxides derived from Class IIIB metal ore or the individual oxides to a solution formula consisting essentially of about 24.2 parts by weight of phosphoric acid, about 0.5 parts by weight of zinc oxide, and about 1.0 part by weight of a sulfated surfactant, B. Adding materials selected from the group consisting of sugars and starch in the approximate norm amount three-fourths of the solution formula weight, C. Adding sodium hydroxide and others of the Classes IA and IIA Periodic metal hydroxides in the approximate norm amount three-eighths of the solution formula weight, D. Adding calcium carbonate ($CaCO_3$) in pulverized form in the approximate norm amount one-eighth of the solution formula weight, E. Mixing, and adding to a reduction container, F. Applying heat to the mixture sufficient to boil off gases, G. Applying heat to the mixture sufficient to cause combustible materials to burn, H. Smelting the remaining material to produce Class IIIB metal ingot and matte in both fuzed and non-fuzed states.

2. The process of claim 1 wherein the Class IIIB Periodic metal ore is in the forms of Monazite, Carnotite, and Uraninite or Pitchblende, and oxides as derived from them.

3. The process of claim 1 wherein the sulfated surfactant is an alkylphenol polyglycol ether.

4. The process of claim 1 wherein the sugars and starch are in the forms of Sucrose and animal sugar ($C_{12}H_{22}O_{11}$), Glucose ($C_6H_{12}O_6$), Fructose ($C_6H_{12}O_6$), and starch ($C_6H_{10}O_5$).

5. The process of claim 1 wherein the reduction container is subjected to standard atmospheric environment at reduction area.

6. The process of claim 1 wherein the reduction container is subjected to controlled vacuum-inert atmospheric environment at reduction area, and from which gaseous metal may exit.

7. The process of claim 1 wherein the burning is partially caused by the chemical union of hydrocarbon gases created within the process mixture and the oxygen from the process ore.

8. The process of claim 1 wherein the base hydroxide is sodium hydroxide and others as may be selected from the Classes IA and IIA metals of the Periodic Table of Elements.

9. The process of claim 1 wherein the smelted Class IIIB metal collects at the bottom of the reduction container crucible.

10. The process of claim 1 wherein the smelted Class IIIB metal is vaporized during smelting and is collected as the metal in an auxiliary condenser.

* * * * *